United States Patent [19]

Douglass

[11] Patent Number: 5,077,534

[45] Date of Patent: Dec. 31, 1991

[54] CLASS J TIME DELAY FUSE

[75] Inventor: Robert S. Douglass, Glencoe, Md.

[73] Assignee: Cooper Industries, Inc., Houston, Tex.

[21] Appl. No.: 600,473

[22] Filed: Oct. 19, 1990

[51] Int. Cl.[5] ..... H01H 85/04

[52] U.S. Cl. ..... 337/164; 337/165; 337/293

[58] Field of Search ..... 337/163, 164, 165, 166, 337/293

[56] References Cited

U.S. PATENT DOCUMENTS 3,061,700 10/1962 Fister ..... 337/164

3,122,619 2/1964 Fister ..... 337/164

FOREIGN PATENT DOCUMENTS 1175380 12/1969 United Kingdom ..... 337/164

*Primary Examiner*—Harold Broome

*Attorney, Agent, or Firm*—Nelson Blish

[57] ABSTRACT

A time-delay fuse (10) having parallel fusible element (22). The fuse element (22) is connected to a trigger mechanism (30) by solder or other meltable alloy. The trigger section (30) provides overload protection and the parallel fuse element (22) provide short circuit protection resulting in a time-delay fuse which can be used in places where there are size restrictions.

7 Claims, 3 Drawing Sheets

CLASS J TIME DELAY FUSE

BACKGROUND OF THE INVENTION

This invention relates to fuses in general and in particular to an electric fuse that meets the minimum requirements of the Underwriter's Laboratories (UL) specification for Class J dimensioned fuses having time delay. A time-delay fuse is a type of fuse that has a built in delay that allows temporary and harmless inrush currents to pass without opening, but is designed to open on sustained overloads and short circuits.

The time-delay fuse can be a dual-element fuse and is used in circuits subjected to temporary inrush current transients, such as motor starting currents, to provide both high performance short-circuit current protection and time-delay overload current protection. Over sizing in order to prevent nuisance openings is not necessary. The dual-element fuse contains two distinctly separate types of elements which are series connected. Fuse links similar to those used in the single-element fuse perform the short-circuit protection function. The overload element provides protection against low-level over currents or overloads and will hold a overload which is five times greater than the ampere rating of the fuse for a minimum time of 10 seconds.

Underwriter's Laboratories has developed basic physical specifications and electrical performance requirements for fuses with voltage ratings of 600 volts or less. These are known as UL Standards. If a type of fuse meets the requirements of a standard, it will be placed in that UL Class. Typical UL Classes are K, RK1, RK5, G, L, H, T, CC, and J.

Class J fuses are rated to interrupt 200,000 amperes a.c. They are UL labeled as "Current Limiting", are rated for 600 volts a.c., and are not interchangeable with other classes. In order for a Class J fuse to be a time-delay fuse it is necessary that the fuse meet not only the voltage and current characteristics required but the physical size limitations required by Underwriter's Laboratories. Thus the time-delay element and the short circuit element must be small and compact. It is necessary to have a fuse which is high capacity, fast acting, with time-delay, and yet will fit in the small package dictated by Underwriter's Laboratories for Class J fuses.

SUMMARY OF THE INVENTION

The short-circuit or fusible element is comprised of parallel fuse strips in the present invention. These provide an equal distribution of current densities to each of the parallel, weak-spot paths for the purpose of increasing the current capacity for 500% overload survivability. This increased capacity combined with the large surface area heat transfer allows for a minimal cross-sectional weak spot area to exist for the purpose of reducing the short-circuit $I^2t$ and satisfy the UL requirements for maximum allowable $I^2t$ for a Class J time-delay fuse. A heater strip provides a large surface area to absorb heat. The heater strip also connects trigger assemblies in parallel so that as one trigger assembly is released due to heat buildup, electrical current is redistributed to remaining trigger assemblies.

DETAILED DESCRIPTION OF THE INVENTION

Figure 2:
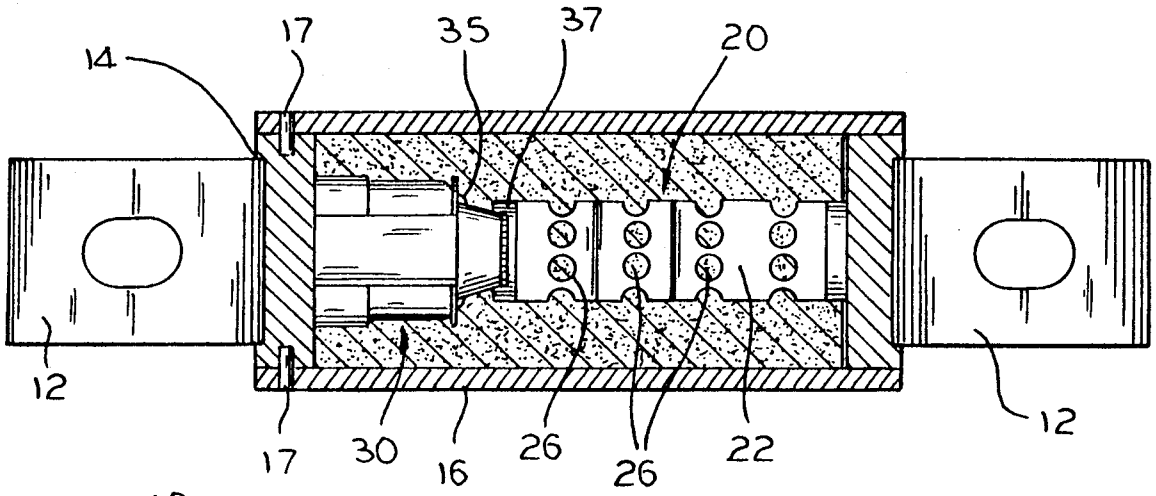
FIG. 2 is a cross sectional view of the fuse shown in FIG. 1 rotated 90°.
Figure 1:
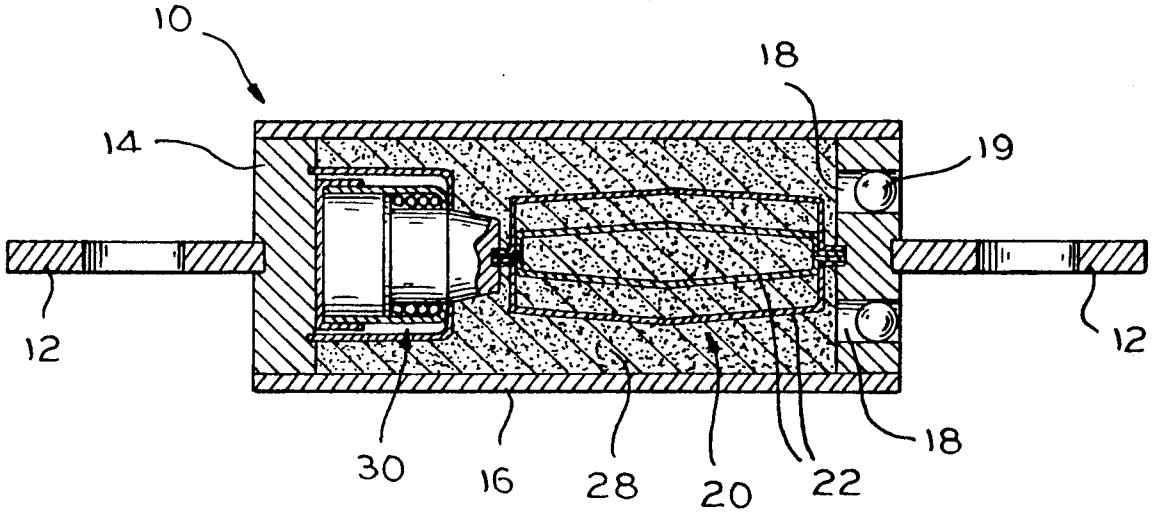
FIG. 1 shows a cross sectional view of an embodiment of the invention having a heater assembly and fuse links in parallel.

Referring to FIG. 1 and FIG. 2 there is shown a fuse, designated in general by numeral 10, having a high interrupting capacity and incorporating a time-delay feature. The terminal 12 and end bell 14 connect fuse 10 to outside electrical connections. Internal components of the fuse 10 are surrounded by tube 16, which is attached to end bells 14 by pins 17.

The two main components of fuse 10 are the short circuit section 20, and the over load or trigger mechanism 30. The short circuit section is comprised of fuse elements 22 assembled in parallel. Fuse element 22 has holes 26 which provide weak spots in fuse element 22.

Figure 3:
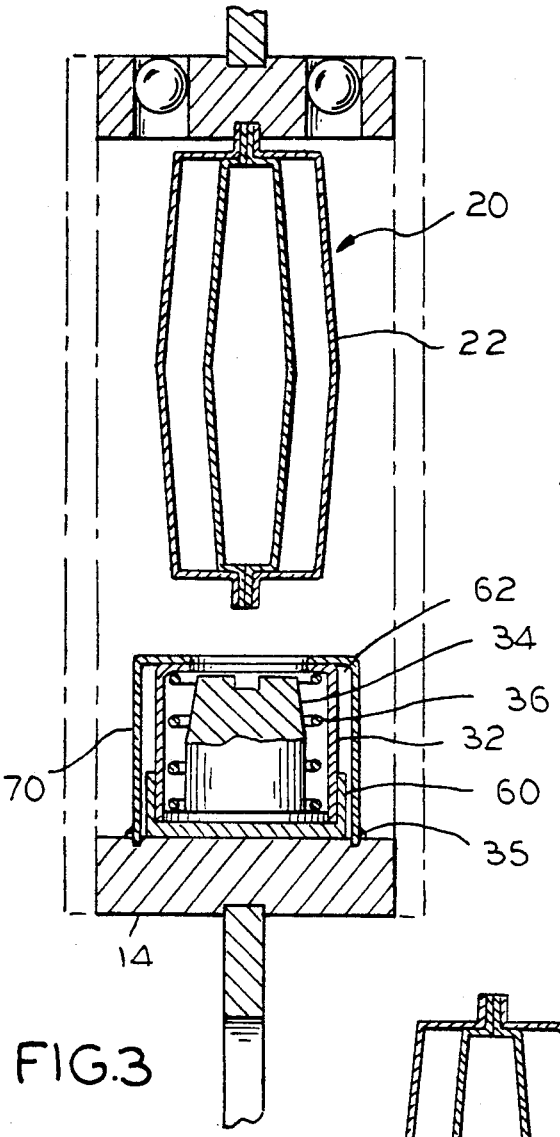
FIG. 3 shows a side view of a fuse according to the present invention with the trigger mechanism activated and retracted.
Figure 4:
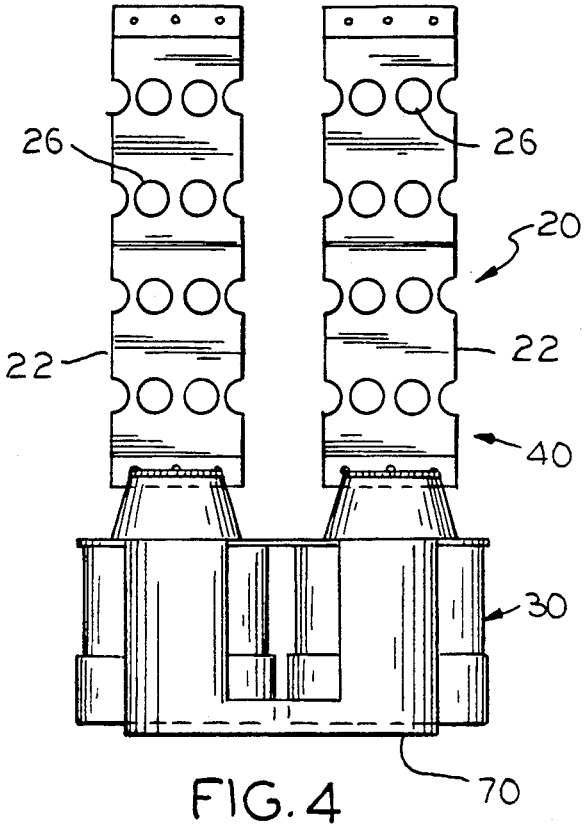
FIG. 4 shows the present invention with four fuse element assemblies connected in parallel.

Trigger mechanism 30 is comprised, as shown in FIG. 3, of an absorber 32 attached by fusing alloy 35, shown in FIG. 2, to trigger 34. Spring 36 is held in compression by a lip on absorber 32 and complimentary lip on trigger 34. The end of absorber 32 is covered by insulator 60, which electrically insulates absorber 32 from end bell 14. Insulator 60 seals off chamber 62 from filler 28 to prevent inhibiting movement of trigger 30. Trigger mechanism 30 and short circuit section 20 comprise a fuse element assembly 40(FIG. 4).

Referring again to FIG. 1, it is seen that fuse element 22 is attached to trigger 34 by fusing alloy 37. In an overload condition, when current higher than the rated current, but not at the short circuit current, passes through the fuse, absorber 32 begins to heat up. At some point fusing alloy 35 and fusing alloy 37 will melt. At that point, trigger 34 is free to slide with respect to fuse element 22, and is forced away from fuse element 22 by spring 36, as shown in FIG. 3, interrupting the current passing through fuse 10.

In a short circuit situation, the current passing through fuse 10 is high enough to burn through the weak spots in fuse element 22 formed by holes 26 thus, interrupting current through fuse 10.

Filler 28 is added to fuse 10 through file holes 18, shown in FIG. 1. After addition of the filler, such as stone sand or quartz sand, plug 19 is inserted to close hole 18.

FIG. 4 shows another embodiment of the present invention which incorporates heater elements 70 capable of holding four trigger mechanisms 30. In this embodiment a higher capacity fuse can be manufactured still using trigger 34, and fuse elements 22, both of a standard size which has been used singularly in smaller, lower ampere rated fuses.

Figure 5:
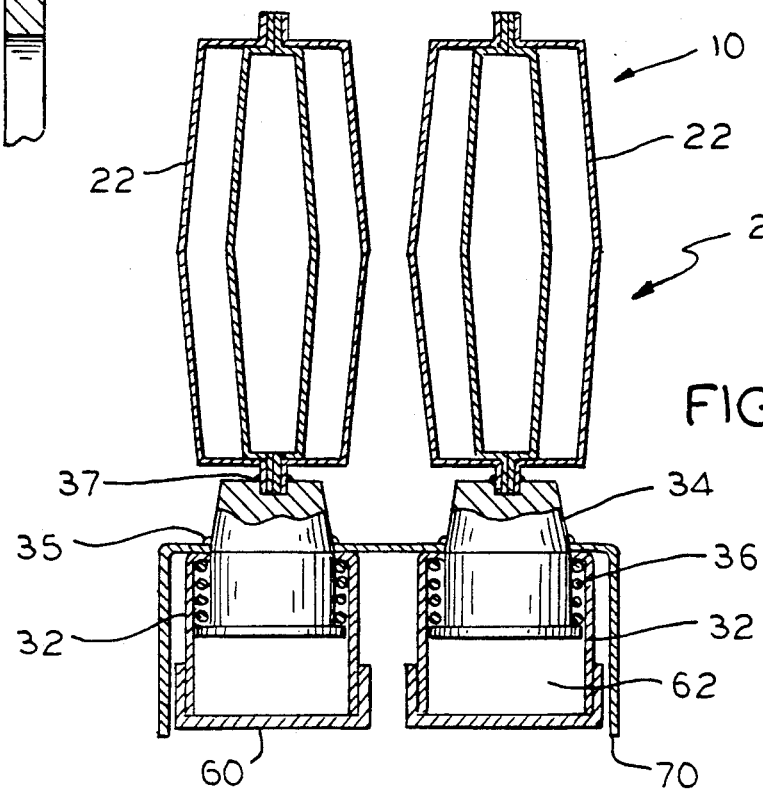
FIG. 5 shows a cross sectional view of the four parallel fuse element assemblies shown in FIG. 4 rotated 90°.

FIG. 5 shows a side view of the fuse 10, shown in FIG. 4. rotated 90°, with four short circuit sections 20. The short circuit sections 20 and mechanisms 30 triggers are usually used in groups of 1, 2, 4, 6 or 8, but any number may be used together.

Figure 6:
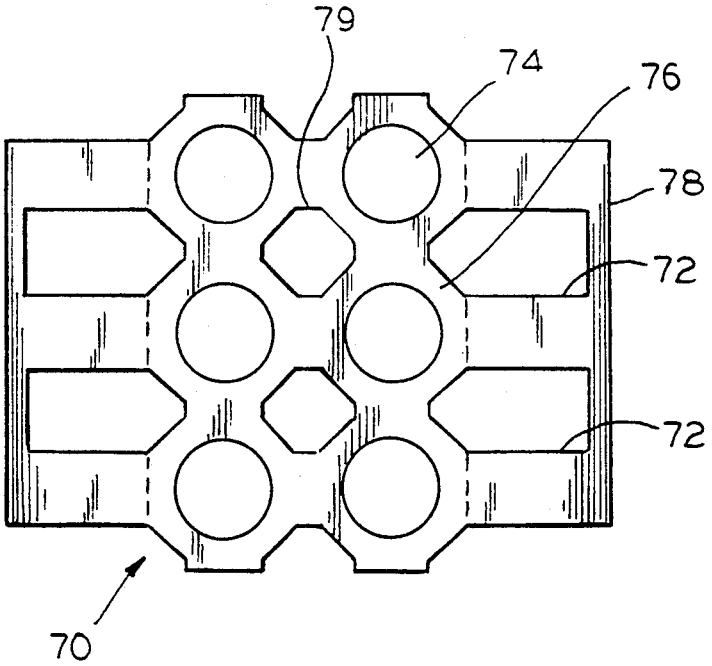
FIG. 6 shows a heater strip that will accommodate six fuse element assemblies.

FIG. 6 shows a heater element 70 which includes legs 72, bridges 76, trigger opening 74, web support 78, and filler openings 79. This heater element will accommodate six fuse assemblies.

Figure 7:
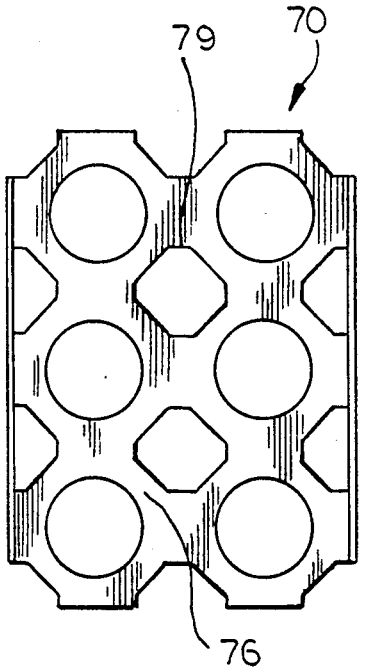
FIG. 7 shows the heater strip of FIG. 6 with the legs folded downward at 90°.

FIG. 7 shows a heater strip of FIG. 6 with legs 72 folded downward at 90°.

Figure 8:
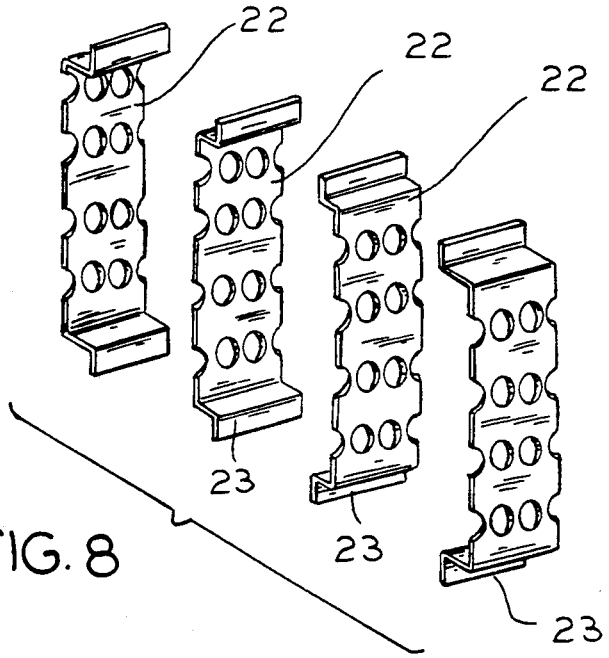
FIG. 8 shows an exploded view of the fuse elements according to the present invention.

FIG. 8 shows an exploded view of short circuit section 20 with fuse elements 2 separated. Fuse element ends 23 may be joined by crimping, soldering, or other means well known in the art.

I claim:

1. A fuse comprising:

a first end bell attached to a first terminal;

a second end bell attached to a second terminal;

at least one fuse element assembly between said first and second end bells; said fuse assembly having a heater element electrically connected to said first end bell, a trigger mechanism electrically connected to said first end bell and said heater, a short circuit section electrically connected to said trigger mechanism and said second end bell, said short circuit section having a plurality of fuse elements in parallel; and a tube connected to said first end bell and said second end bell and enclosing said fuse element assembly.

2. A fuse as in claim 1 comprising a plurality of fuse element assemblies and said heater electrically connecting each of said fuse element assemblies to said second end bell.

3. A fuse comprising:

first and second end bells, a plurality of longitudinally extending fuse elements attached at opposite ends to each other;

one attached end of said fuse elements connected in electrical series with said second end bell;

a trigger connected in electrical series to the other attached end of said fuse elements;

said trigger attached to said fuse elements by a fusing alloy;

a spring connected to said trigger urging said trigger to move axially away from the other end of said fuse elements, a heating element electrically connecting said first end bell and said trigger wherein when the heater causes the fusing alloy to melt, the spring moves the trigger away from the other attached end of the fuse elements and interrupts current passing through said fuse.

4. The fuse of claim 3 comprising a fuse tube enclosing said fuse elements and trigger and attached to said first and second end bells, and filler within said tube surrounding said fuse elements.

5. The fuse of claim 3 wherein the fuse elements are assembled in parallel and each fuse element has a plurality of holes.

6. A fuse comprising first and second end bells;

a plurality of fuse assemblies assembled in parallel with each fuse assembly electrically connected to the first and second end bells;

each fuse assembly having (a) a plurality of longitudinally extending fuse elements connected at opposite ends to each other, (b) a trigger electrically connected to one end of said fuse elements;

(c) a spring means connected to said trigger urging said trigger to move axially away from the one end of said fuse elements, and (d) releasing means to releasably hold said trigger to said one end;

each other end of said fuse elements electrically connected to said first end bell, each trigger of said fuse assemblies electrically connected to said second end bell, a heater means electrically connecting each trigger of said fuse assemblies to said second end bell wherein when the heater causes the releasing means to release said spring moves the trigger away from the fuse elements one end.

7. The fuse of claim 6 wherein the releasable means is fusible alloy and the fuse elements each have a plurality of holes.

* * * * *